US008327468B2

(12) United States Patent
Bronstein et al.

(10) Patent No.: US 8,327,468 B2
(45) Date of Patent: Dec. 11, 2012

(54) VEST INSERT FOR TACTICAL TRAINING

(76) Inventors: Lawrence Greg Bronstein, Clifton, VA (US); Louis Greg Bronstein, Harker Heights, TX (US)

( * ) Notice: Subject to any disclaimer, the term of this patent is extended or adjusted under 35 U.S.C. 154(b) by 483 days.

(21) Appl. No.: 12/654,266

(22) Filed: Dec. 15, 2009

(65) Prior Publication Data

US 2010/0162459 A1 Jul. 1, 2010

Related U.S. Application Data

(60) Provisional application No. 61/193,866, filed on Dec. 31, 2008.

(51) Int. Cl.
*A41D 13/015* (2006.01)

(52) U.S. Cl. ..... 2/455; 89/36.05

(58) Field of Classification Search ..... 2/2.5, 102, 2/463, 455, 467; 89/36.05, 922
See application file for complete search history.

(56) References Cited

U.S. PATENT DOCUMENTS

| | | | | |
|---|---|---|---|---|
| 3,452,362 | A | 7/1969 | Korolick et al. | |
| 3,855,632 | A | 12/1974 | Davis | |
| 4,195,362 | A | 4/1980 | Rolando | |
| 4,266,297 | A | 5/1981 | Atkins | |
| 4,373,211 | A | 2/1983 | Goudreau et al. | |
| 4,425,667 | A | 1/1984 | Harrison | |
| 4,466,135 | A | 8/1984 | Coppage, Jr. | |
| 4,485,491 | A | 12/1984 | Rasmussen | |
| 4,507,802 | A | 4/1985 | Small | |
| 4,774,724 | A | 10/1988 | Sacks | |
| 5,157,792 | A | 10/1992 | Allen et al. | |
| 5,495,620 | A | 3/1996 | Schoenweiss et al. | |
| 5,722,093 | A * | 3/1998 | Andresen | 2/23 |
| 6,148,447 | A | 11/2000 | Bain et al. | |
| 6,175,958 | B1 | 1/2001 | Wu | |
| 6,446,273 | B1 * | 9/2002 | Gillen et al. | 2/455 |
| 6,738,984 | B2 | 5/2004 | Gillen et al. | |
| 7,076,806 | B1 * | 7/2006 | Van Winkle et al. | 2/2.5 |
| 7,093,301 | B1 * | 8/2006 | Moore, Jr. | 2/2.5 |
| 2002/0132089 | A1 | 9/2002 | Bettencourt | |
| 2004/0158910 | A1 | 8/2004 | Bay | |
| 2007/0000010 | A1 * | 1/2007 | Benini | 2/69 |
| 2008/0307569 | A1 * | 12/2008 | Roberts | 2/456 |

FOREIGN PATENT DOCUMENTS

| | | |
|---|---|---|
| FR | 2586535 A1 | 3/1987 |
| FR | 2699265 A1 | 6/1994 |

* cited by examiner

*Primary Examiner* — Katherine Moran
(74) *Attorney, Agent, or Firm* — Richard C. Litman

(57) ABSTRACT

The vest insert for tactical training is an insert kit for retrofitting an outer tactical vest or the like for tactical training purposes. The vest insert includes front and rear training plates adapted to be removably received within front and rear pockets of front and rear carriers of an outer tactical vest. Each of the front and rear training plates has an opening formed therethrough to indicate that the plate is for training purposes. Each of the front and rear training plates is formed from polyvinyl chloride. Additionally, a pair of front and rear fabric panels are provided to replace the inner panels of the outer tactical vest, each of the front and rear fabric panels being formed from woven polyvinyl chloride. The training plates and the front and rear fabric panels are sized and shaped to match the inserts and inner panels of a typical outer tactical vest.

3 Claims, 7 Drawing Sheets

VEST INSERT FOR TACTICAL TRAINING

CROSS-REFERENCE TO RELATED APPLICATION

This application claims the benefit of U.S. Provisional Patent Application Ser. No. 61/193,866, filed Dec. 31, 2008.

BACKGROUND OF THE INVENTION

1. Field of the Invention

The present invention relates to ballistics vests and the like, and particularly to a vest insert for tactical training that provides an insert kit for retrofitting an outer tactical vest or the like for tactical training purposes with non-ballistic materials.

2. Description of the Related Art

A ballistic or tactical vest is an item of protective clothing that absorbs the impact from firearm-fired projectiles and shrapnel fragments from explosions. This protection is for the torso. Soft vests are typically made from many layers of woven or laminated fibers, such as Kevlar®, and protect wearers from projectiles fired from handguns, shotguns, and small fragments from explosives such as hand grenades. When metal or ceramic plates are used with a soft vest, the vest can also protect wearers from shots fired from rifles. In combination with metallic components or tightly-woven fiber layers, soft armor can further offer some protection to the wearer from stab and slash from a knife. Soft vests are commonly worn by police forces, private citizens and private security guards, and hard-plate reinforced vests are mainly worn by combat soldiers in the armies of various nations as well as police armed-response units.

FIG. 2A illustrates a typical prior art outer tactical vest V, including front and rear carriers 20, 22, joined together by straps 26 and fasteners, such as hook and loop fasteners, and further including side carrier panels 28 and a ballistics collar 24. As best shown in FIG. 2B, the front carrier 20 includes a pocket 30, typically formed on the rear face thereof, for receiving a small arms protective insert (SAPI) 32 or the like. A SAPI is typically a ceramic plate formed from boron carbide, silicon carbide or the like. As shown in FIG. 2C, the SAPI 32 is contoured to comfortably mate with the user's torso, and may have indicia 34 formed thereon. Positioned between the rear face of the front carrier 20 and the user's torso is a front panel 21, typically formed from folded Kevlar® or the like. Such panels are fastened to the front carrier 20 through the usage of hook and loop fasteners or the like. A similar arrangement, including a rear pocket, a rear SAPI and a rear Kevlar® panel is typically provided for the rear carrier 22.

In order to provide further clarification, outer tactical vests (OTVs), such as exemplary vest V, typically include side and rear pockets for receiving fabric ballistic panels, and holding these panels in place. Typically, OTVs also include front and rear pockets for carrying the SAPI plates. Some OTVs function solely as rigid ballistic SAPI plate carriers, and training SAPI plates may directly replace ballistic plates as a training alternative.

Flexible ballistic armor fabric panels fit into the side and rear pockets, which are typically sewn into the OTV. The ballistic fabric panels typically hang by shoulder support straps that are held in place by hook and loop fasteners. The OTV pockets that carry the fabric panels are also typically closed by use of hook and loop fasteners.

The SAPI and Kevlar® panels of the typical outer tactical vest are bulky, unwieldy, relatively hot when worn, as folded Kevlar® is not a breathable material, and relatively difficult to clean. Although necessary or combat purposes, it would be desirable to provide more convenient and comfortable materials for training purposes. Thus, a vest insert for tactical training solving the aforementioned problems is desired.

SUMMARY OF THE INVENTION

The vest insert for tactical training is an insert kit for retrofitting an outer tactical vest or the like for tactical training purposes. A tactical training vest including the vest insert is also contemplated. The vest inset for tactical training includes front and rear training plates adapted to be removably received within front and rear pockets of front and rear carriers of an outer tactical vest. Each of the front and rear training plates has a substantially arcuate cross-sectional configuration to match the curvature of the wearer's torso, and further has an opening formed therethrough. The opening indicates that the front and rear training plates are for training purposes. Indicia may also be formed on each training plate marking each plate as being for training purposes. Each of the front and rear training plates is formed from polyvinyl chloride.

Additionally, a pair of front and rear fabric panels is provided to replace the inner panels of the outer tactical vest (typically formed from folded Kevlar®). Each of the front and rear fabric panels is adapted for respective releasable attachment to a rear face of the front carrier and a front face of the rear carrier. Each of the front and rear fabric panels is formed from woven polyvinyl chloride. The front and rear fabric panels are attached to the front and rear carriers, respectively, by hook and loop fasteners or the like. The training plates and the front and rear fabric panels, although formed from polyvinyl chloride, are sized and shaped to match ceramic SAPIs and the Kevlar® inner panels of an outer tactical vest. Similarly, the training plates and front and rear panels have weights matching those of the actual combat materials, in order to provide proper simulation during training.

It should be noted that the training plates and the training panels do not provide ballistic protection. Further, both the plates and panels preferably are colored, in order to distinguish them as non-ballistic materials to prevent accidental usage in combat. Conventional SAPIs are black, whereas the training plates in the preferred embodiment are preferably extruded from white or light blue polyvinyl chloride. Similarly, the combat panels are typically colored green or in a multitude of camouflage colors. The training panels of the present invention are preferably formed as brown, gunmetal grey or black panels.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
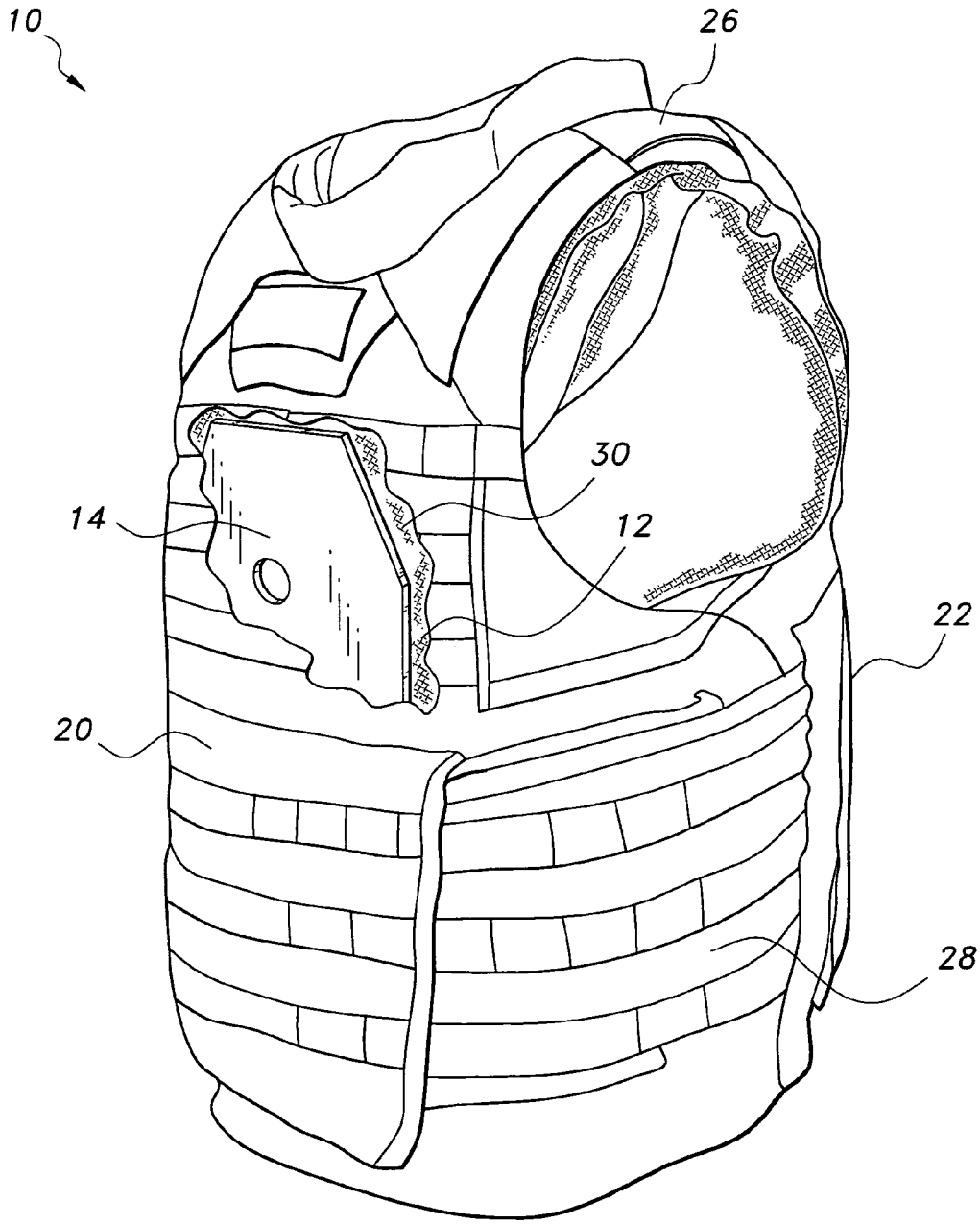
FIG. 1A is an environmental perspective view of a vest insert for tactical training according to the present invention, the vest being broken away to show the vest insert.

Referring to FIG. 1A, there is shown a training vest 10 including the present vest insert for tactical training. The vest insert for tactical training is an insert kit for retrofitting an outer tactical vest or the like for tactical training purposes. Both the insert kit and the training vest including the training insert are contemplated.

Figure 1B:
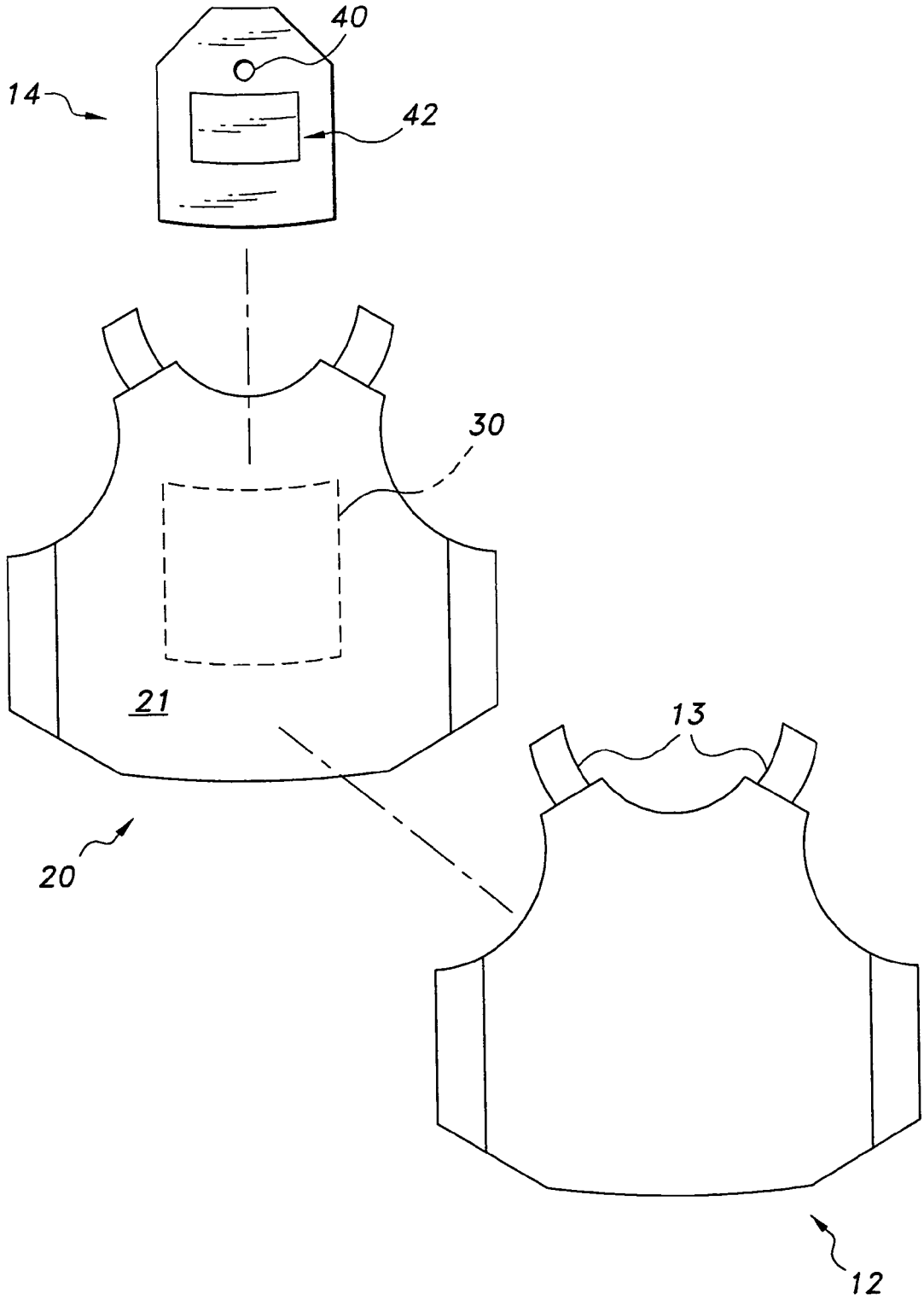
FIG. 1B is an exploded, environmental perspective view of the vest insert of FIG. 1 being applied to a front carrier of an outer tactical vest.
Figure 2A:
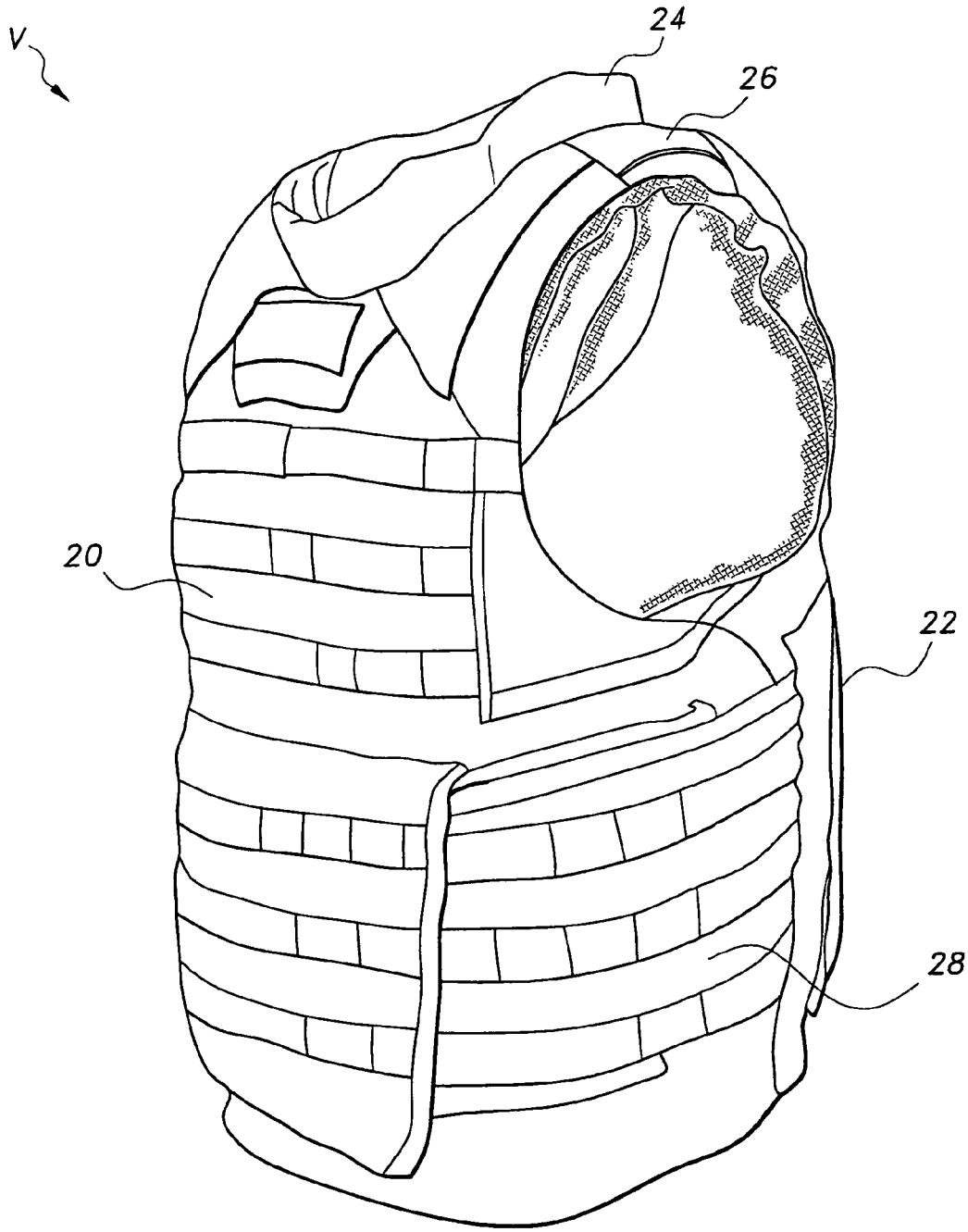
Fig. 2A PRIOR ART
FIG. 2A is a perspective view of a prior art outer tactical vest.
Figure 2B:
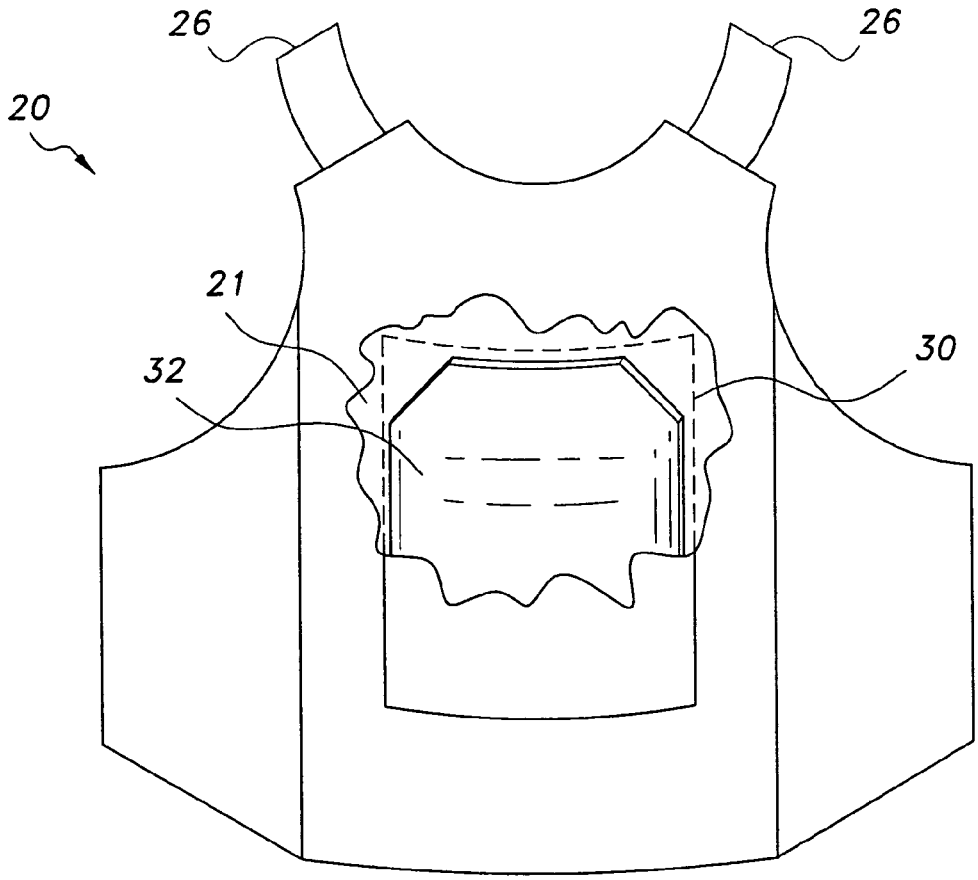
Fig. 2B PRIOR ART
FIG. 2B is a front view of the front carrier of the prior art outer tactical vest of FIG. 2A, broken away to show a protective insert of the prior art.
Figure 2C:
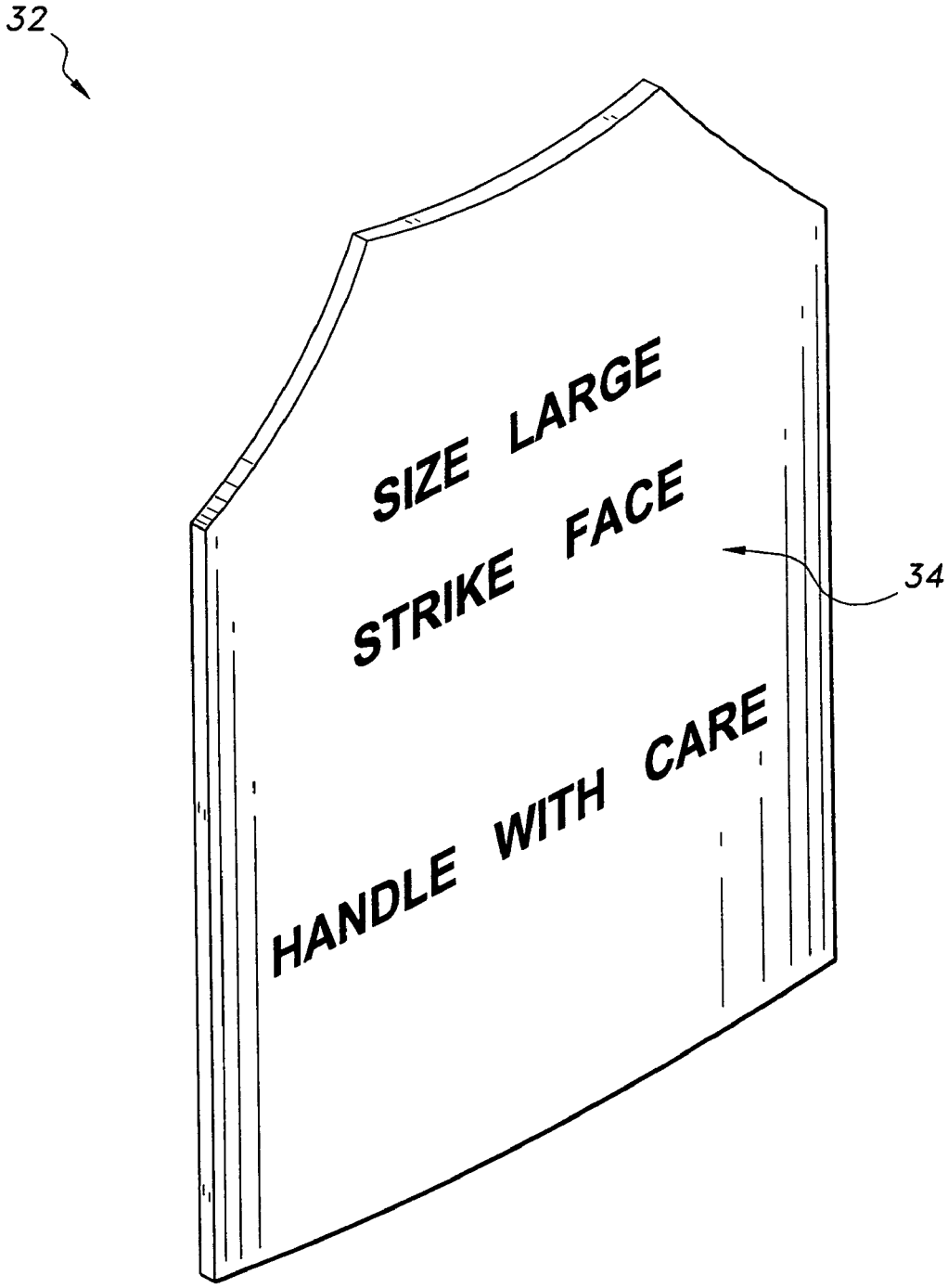
Fig. 2C PRIOR ART
FIG. 2C is a perspective view of a small arms protective insert according to the prior art for use with the tactical vest of FIG. 2A.

As shown in FIG. 1A, the front carrier 20, rear carrier 22, side carrier panels 28 and attachment straps 26 of the outer tactical vest V of FIG. 2A are utilized for training. It should be understood that the vest insert shown in FIG. 1A may be used with any type of tactical or bulletproof garment, and that the prior art outer tactical vest of FIG. 2A is shown for exemplary purposes only. The folded Kevlar® panel 21 and the SAPI 32 of FIGS. 2B and 2C, however, are replaced in FIG. 1A by a front training panel 12 and a training plate 14. In FIGS. 1A and 1B, only the front carrier 20 and a matching front training panel 12 and training plate 14 are shown. It should be understood that a matching rear training panel and rear training plate are also provided for attachment to the rear carrier 22.

Figure 3:
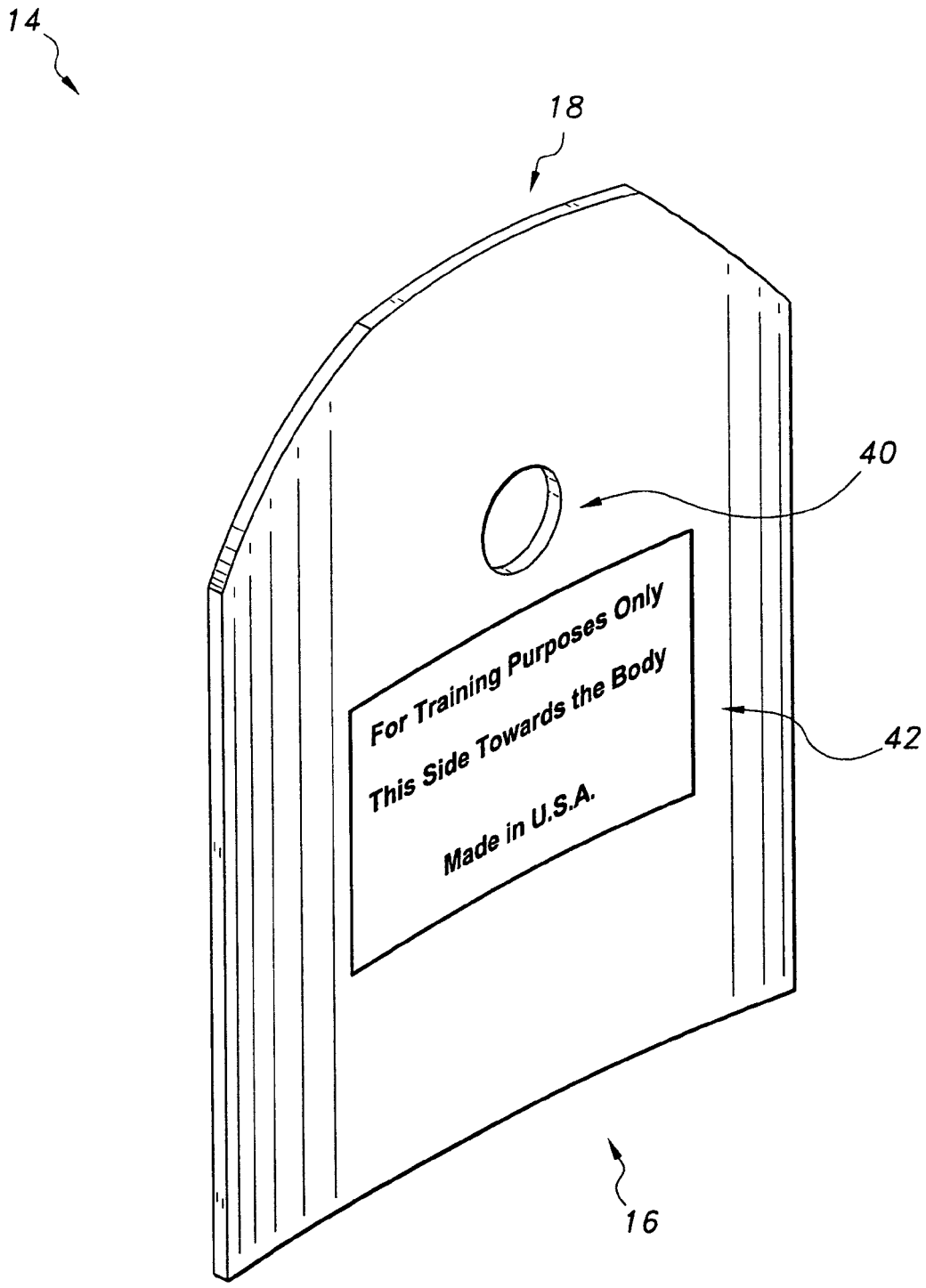
FIG. 3 is a perspective view of a training plate of the vest insert for tactical training according to the present invention.

The front and rear training plates 14 are respectively removably received within the front and rear pockets 30 of the front and rear carriers 20, 22 of the outer tactical vest 10. As described above, the prior art vest V, including front and rear carriers 20, 22, is shown for exemplary purposes only, as are the exemplary pockets 30. Each of the front and rear training plates 14 has a substantially arcuate cross-sectional configuration, as best shown in FIG. 3, to match the curvature of the wearer's torso. Each training plate 14 has an upper end 18 and a lower end 16. As shown in FIG. 3, the upper end 18 or upper portion may be substantially trapezoidal (or a curved trapezoid), and the lower end 16 or lower portion may be substantially rectangular (or a curved rectangle). The shape of the training plate 14 is designed to match that of the actual SAPI 32, which is used in combat.

Each training plate 14 is preferably formed by extruding solid polyvinyl chloride through a mold under pressure and heat to form a rigid, continuous running sheet, having widths varying from approximately 7½ inches to approximately eleven inches, depending upon the size of the SAPI that the training plate 14 is replacing. The running sheet is curved to match the front and back of the wearer's upper torso to provide a comfortable fit. The polyvinyl chloride sheets have thicknesses of approximately ¾ of an inch to simulate a typical ballistic SAPI. Each sheet is then cut into lengths varying from approximately 11½ inches to approximately fourteen inches, depending upon the size of the SAPI that the training plate 14 is replacing. It should be understood that the training plates 14 may be formed by any other suitable method, such as injection molding or the like. Each training plate 14 may further include filler materials, such as wood, rubber or the like, allowing for the weight of each plate 14 to be varied in order to match that of the SAPI that the plate 14 replaces.

Further, as best shown in FIG. 3, the training plate has an opening 40 formed therethrough, which may be a circular aperture, as shown. The opening 40 provides a visual indication that the front and rear training plates 14 are for training purposes only, in order not to confuse training plate 14 with the continuous surface of SAPI 32. The opening 40 preferably has a diameter of between approximately 1½ inches and 2½ inches. Indicia 42 may also be formed on each training plate 14, marking each plate as being for training purposes. Each of the front and rear training plates is formed from polyvinyl chloride.

Additionally, the pair of front and rear fabric panels 12 are provided to replace the inner folded Kevlar® panels 21 of the prior art outer tactical vest V. Each of the front and rear fabric panels 12 is adapted for respective releasable attachment to a rear face 21 of the front carrier 20 and a front face of the rear carrier. The front and rear fabric panels 12 are attached to the front and rear carriers, respectively, by hook and loop fasteners or the like. The front and rear fabric panels 12 are attached to the front and rear carriers using the same type of releasable attachment used by the folded Kevlar® panels 21, which they replace.

Each of the front and rear fabric panels 12 are formed from woven polyvinyl chloride. The training plates 14 and the front and rear fabric panels 12, although formed from polyvinyl chloride, are sized and shaped to match ceramic SAPIs 32 and the Kevlar® inner panels 21 of the outer tactical vest V. Similarly, the training plates 14 and front and rear panels 12 have weights matching those of the actual combat materials in order to provide proper simulation during training. The polyvinyl chloride training plate 14, however, is easier to clean, as is the woven polyvinyl chloride fabric panel 12. The woven polyvinyl chloride fabric panel 12 is also more flexible and is breathable, when compared to the folded Kevlar® inner panels 21. Training plates 14 and fabric panels 12 are also less expensive to produce and replace than the combat materials that they replace during training.

It should be noted that the training plates and the training panels do not provide ballistic protection. Further, both the plates and panels preferably are colored, in order to distinguish them as non-ballistic materials to prevent accidental usage in combat. Conventional SAPIs are black, whereas the training plates in the preferred embodiment are preferably extruded from white or light blue polyvinyl chloride. Similarly, the combat panels are typically colored green or in a multitude of camouflage colors. The training panels of the present invention are preferably formed as brown, gunmetal grey or black panels.

It should be understood that the vests shown in the drawings are shown for exemplary purposes only. For example, a variant of vest V may include a pair of side panels replacing the single front panel shown. Thus, the vest may only have a pair of side training panels and a rear training panel. It should be understood that the vest insert contemplates replacement of the Kevlar® inner panels of an outer tactical vest, and the replacement training panels match in number, size and shape the Kevlar® inner panels, and that the number, size and shape of the training panels is not limited to the exemplary panels shown in the drawings.

Figure 4:
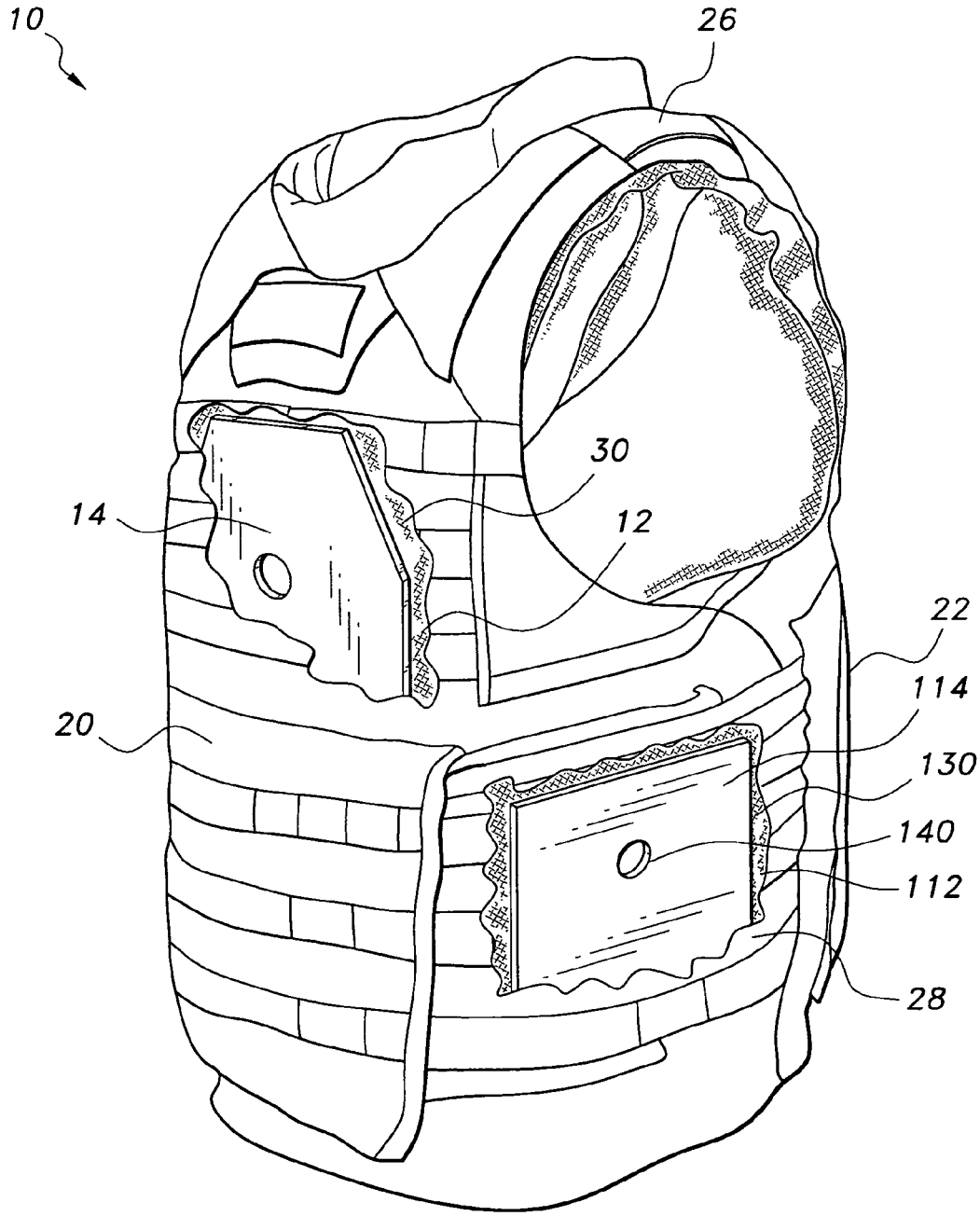
FIG. 4 is an environmental perspective view of an alternative embodiment of the vest insert for tactical training according to the present invention, the vest being broken away to show the vest inserts.

Additionally, it should be understood that additional training plates may be used. For example, in the alternative embodiment of FIG. 4, the typical tactical vest also includes a side pocket 130 formed in side carrier 28 for receiving a side SAPI, as is conventionally known. For such a vest, a side training plate 114 is removably placed within the side pocket 130 of the side carrier 28, replacing the side SAPI, as described above with respect to the front and rear training plates 14. Similar to that described above with respect to front and rear training plates 14, a side fabric panel 112 is provided to replace the inner folded Kevlar® panel of the prior art outer tactical vest V, corresponding to the side carrier 28. The side fabric panel 112 is adapted for respective releasable attachment to an inner face of the side carrier 28 by hook and loop fasteners or the like, as described above. Side training plate 114 has an opening 140 formed therethrough, similar to opening 40, to visually indicate that this plate is for training purposes only.

It should be noted that, in the above, the non-ballistic training panels which replace the ballistic Kevlar® panels do not require hook and loop fasteners at the shoulder supports (unlike the typical prior art ballistic fabric panels). The training panels themselves are sufficiently rigid to fit into the OTV panel insert pockets without the need for fasteners. This enables the panels to provide structural support for the OTV system. This further enables the tactical training vest system to carry the weight and form of front and rear SAPI plates. Thus, the usage of the non-ballistic training SAPI plates and non-ballistic flexible fabric insert panels allows for realistic simulation, in terms of size, weight and functionality, of OTVs equipped with actual ballistic armor panels and plates.

It is to be understood that the present invention is not limited to the embodiments described above, but encompasses any and all embodiments within the scope of the following claims.

We claim:

1. A vest insert for tactical training, comprising at least one solid, rigid training plate adapted to be removably received within at least one pocket of at least one carrier of a tactical vest, the at least one training plate being:

a) substantially arcuate in cross section;

b) having indicia formed thereon for visually indicating a training function of said at least one training plate, wherein said indicia includes at least an aperture formed through said at least one training plate while the remainder of the plate remains imperforate; and c) made from extruded polyvinyl chloride and being approximately ¾" thick, whereby the training plate substantially replicates a ballistic armor panel in weight, size, shape and is adapted to be inserted into a tactical vest for training purposes.

2. The insert for tactical training as recited in claim 1, wherein the indicia further includes text material for warning the user of the training functionality of the at least one training plate.

3. The insert for tactical training as recited in claim 1, wherein the arcuate cross section defines an arcuate cross section along both longitudinal and transverse axes of the at least one training plate.

* * * * *